US005253581A

United States Patent [19]

Miki et al.

[11] Patent Number: 5,253,581

[45] Date of Patent: Oct. 19, 1993

[54] STAMP DEVICE EMPLOYING A HEAT SENSITIVE STENCIL PAPER TO BE PERFORATED BY HEAT OF A THERMAL HEAD

[75] Inventors: Takashi Miki, Nagoya; Tetsuji Fuwa, Hashima, both of Japan

[73] Assignee: Brother Kogyo Kabushiki Kaisha, Nagoya, Japan

[21] Appl. No.: 22,833

[22] Filed: Feb. 25, 1993

Related U.S. Application Data

[63] Continuation of Ser. No. 811,974, Dec. 23, 1991, abandoned.

[30] Foreign Application Priority Data

Dec. 29, 1990 [JP] Japan ..... 2-417190
May 9, 1991 [JP] Japan ..... 3-104225
May 27, 1991 [JP] Japan ..... 3-121028

[51] Int. Cl.[5] ..... B41L 13/02

[52] U.S. Cl. ..... 101/121; 101/125; 101/127.1

[58] Field of Search ..... 101/128.4, 117, 118, 101/119, 120, 121, 122, 125, 126, 127, 127.1, 128, 128.1, 129

[56] References Cited

U.S. PATENT DOCUMENTS 3,541,956 11/1970 Falchero ..... 101/121
3,799,053 3/1974 Rabelow ..... 101/125
4,497,848 2/1985 Baran et al. ..... 101/129
4,628,813 12/1986 Hasegawa et al. ..... 101/128.4
4,718,340 1/1988 Love ..... 101/128.4
4,957,378 9/1990 Shima ..... 101/128.4

FOREIGN PATENT DOCUMENTS 0130612 3/1986 European Pat. Off. .
3806356A1 6/1988 Fed. Rep. of Germany .
692160 10/1930 France .
54-9523 4/1979 Japan .
287781 12/1986 Japan ..... 101/128.4
73988 4/1987 Japan ..... 101/128.4
63-11855 1/1988 Japan .
224987 9/1988 Japan ..... 101/128.4
498186 5/1976 U.S.S.R. ..... 101/121

*Primary Examiner*—Edgar S. Burr
*Assistant Examiner*—John S. Hilten
*Attorney, Agent, or Firm*—Oliff & Berridge

[57] ABSTRACT

In a stamping device, a stamping stencil is produced and used which does not require manual application of ink to the stencil. Data concerning an image, which may include character, figure and/or symbol data, is input by a input unit, a thermal head generates heat on the basis of the data and transmits the heat to the thermal stencil paper disposed at the printing position. As a result, a corresponding pattern of pores is produced, by the heat of the thermal head, in the thermal stencil paper. Ink is supplied to the pores by an ink supply unit at an ink supplying position when pressure is applied to the back of the ink supply.

31 Claims, 15 Drawing Sheets

THERMAL HEAD
16
STENCIL FEED MOTOR
LIQUID CRYSTAL DISPLAY
14
HEAD DRIVING CIRCUIT
76
MOTOR DRIVING CIRCUIT
77
32
DISPLAY DRIVING CIRCUIT
78
50
62
CPU
OUTPUT INTERFACE
70
THERMAL PUNCHING CG-ROM
68
DISPLAY CG-ROM
69
60
INPUT INTERFACE
ROM
PROGRAM MEMORY
DICTIONARY MEMORY
RAM
INPUT BUFFER
THERMAL PUNCHING BUFFER
SHIFT REGISTER
KEYBOARD
10
58
64
71
72
66
73
74
75

STAMP DEVICE EMPLOYING A HEAT SENSITIVE STENCIL PAPER TO BE PERFORATED BY HEAT OF A THERMAL HEAD

This is a continuation of application Ser. No. 07/811,974 filed Dec. 23, 1991, now abandoned.

BACKGROUND OF THE INVENTION

1. Field of the Invention

The invention relates to a stamp device employing a heat sensitive stencil paper adapted to be perforated by heat of a thermal head and, more particularly, to a stamping device for recording an image by transferring ink through a thermal stencil paper having pores formed by heat of a thermal head which is capable of generating heat in accordance with input data.

2. Description of Related Art

The rubber stamp has been used for impressing addresses, names, and departments and sections of corporations. The rubber stamp is a simple means for printing the same characters repeatedly and can be used by anybody.

However, it requires a long time to procure the rubber stamp because the rubber stamp needs to be made by a stamp maker specialized in the field. Further, a new rubber stamp must be made if the contents of the rubber stamp need changing and hence, in most cases, the rubber stamp has been used for impressing only designs, marks, patterns or characters which are not subject to frequent change for economic reasons.

A compact portable stamping device as shown in FIG. 21 is disclosed in U.S. Pat. No. 3,799,053 (Japanese Examined Patent Publication No. 54-9523). As shown in FIG. 21, the stamping device S1 comprises an ink pad 102, a stencil paper 104 closely sticking to the ink pad 102, and a frame 100 surrounding the ink pad 102 and the stencil paper 104. The ink pad 102 is pressed against a recording sheet P with the stencil paper 104 therebetween for stencil printing. When changing the stencil paper 104, the operator's hands or clothes are often stained by the ink. Further, the ink cannot be replaced by another ink having a different color.

A pressure stencil printer which, for example, is disclosed in Japanese Utility Model Laid-Open Publication No. 63-11855 is a simple printer employing a thermal stencil paper. This printer comprises a platen provided with a pad formed of an elastic material, such as sponge, to support a recording medium, and a pressure plate provided with a support member for supporting a printing plate opposite to the platen. The printing plate is pressed against a recording medium supported on the platen by the pressure plate for printing. In impressing print by the pressure stencil printer, a document having contents to be printed is produced, the document is copied in a pattern of pores formed by thermal punching by means of flash light emitted by a flashtube on a thermal stencil paper, ink is spread over the thermal stencil paper, and then the thermal stencil paper is pressed against a recording medium placed on the platen of the pressure stencil printer for printing, which is very troublesome. Since the ink must be spread over the thermal stencil paper by the operator, the operator's hands may be smeared with the ink or a nonuniform print is formed because it is difficult to spread the ink in a uniform thickness over the thermal stencil paper.

SUMMARY OF THE INVENTION

The invention solves the foregoing problems and it is therefore an object of the present invention to provide a stamping device employing a heat sensitive stencil paper adapted to be perforated by heat of a thermal head.

Another object of the present invention is to provide a stamping device which does not require ink application by the operator and is capable of operating economically while facilitating the stamping operation.

Still another object of the present invention is to provide a stamping device capable of making a stamping stencil provided with characters or figures of a typeface and of making a stamping stencil having a printing area independent of the size of the cartridge.

A stamping device in accordance with the present invention comprises:

an input unit for inputting data concerning an image;

a thermal head unit for forming pores by heat in a thermal stencil paper at a printing position on a basis of input by said input unit;

an ink supply unit for supplying the pores formed in the thermal stencil paper with ink at an ink supplying position; and a stenciling sheet supplying unit for supplying the thermal stencil paper from the printing position to the ink supplying position.

According to the invention, when data concerning an image, that may be of characters, figures and/or symbols, is input by the input unit, the thermal head generates heat on the basis of programmed data concerning the input data and transmits the heat to the thermal stencil paper disposed at the printing position. A corresponding pattern of pores is formed in the thermal stencil paper by the heat of the thermal head, ink is supplied to the pores, formed in the thermal stencil paper, by the ink supply unit at an ink supplying position. Therefore, a stamp image is formed on a medium with the ink by using the pores of the stencil paper supplied with the ink.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

A stamping device in the preferred embodiments according to the invention will be described with reference to the accompanying drawings.

Figure 1:
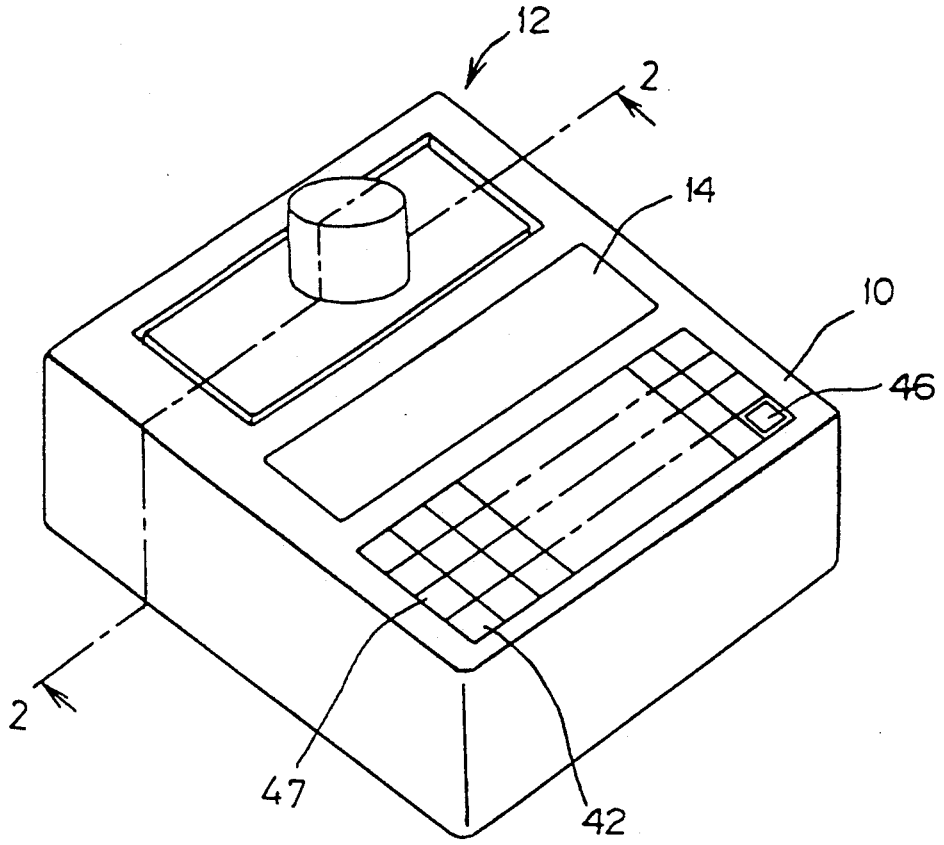
FIG. 1 is a perspective view of a stamping device in a first embodiment according to the present invention.
Figure 3:
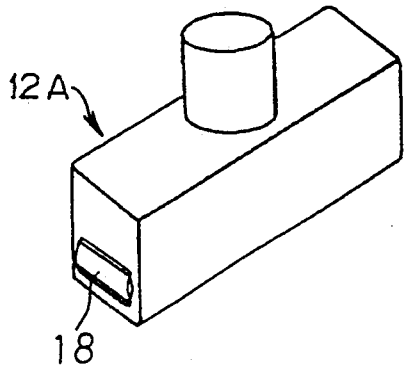
FIG. 3 is a perspective view of a stamping unit used for producing a stamping stencil employed in the stamping device.
Figure 4:
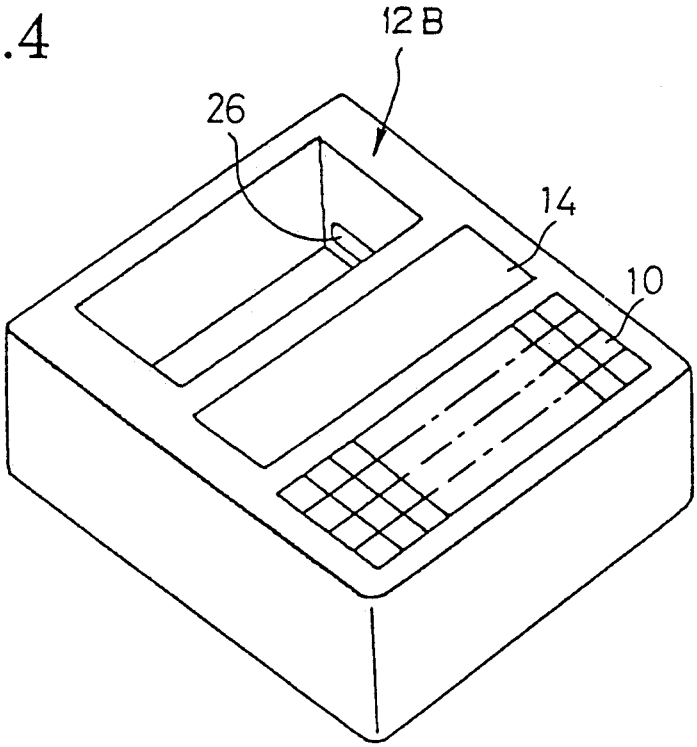
FIG. 4 is a perspective view of a stencil producing unit, in which a stamping unit is separated from the stamping device.

Referring to FIG. 1, the stamping device has a keyboard 10 which functions as an input means for inputting data concerning an image including characters, figures and/or symbols and a liquid crystal display (hereinafter referred to simply as "display") 14 having a predetermined number of display modules for displaying the data concerning the keyboard input image. The stamping device also has a stamping stencil producing unit 12 for producing a stamping stencil. The display 14 is positioned, in the face of the device, between the stamping stencil producing unit 12 and the keyboard 10. As shown in FIGS. 3 and 4, the stamping stencil producing unit 12 comprises a stencil producing unit 12B and a stamping unit 12A, which is detachably combined with the stencil producing unit 12B as described below.

Figure 2:
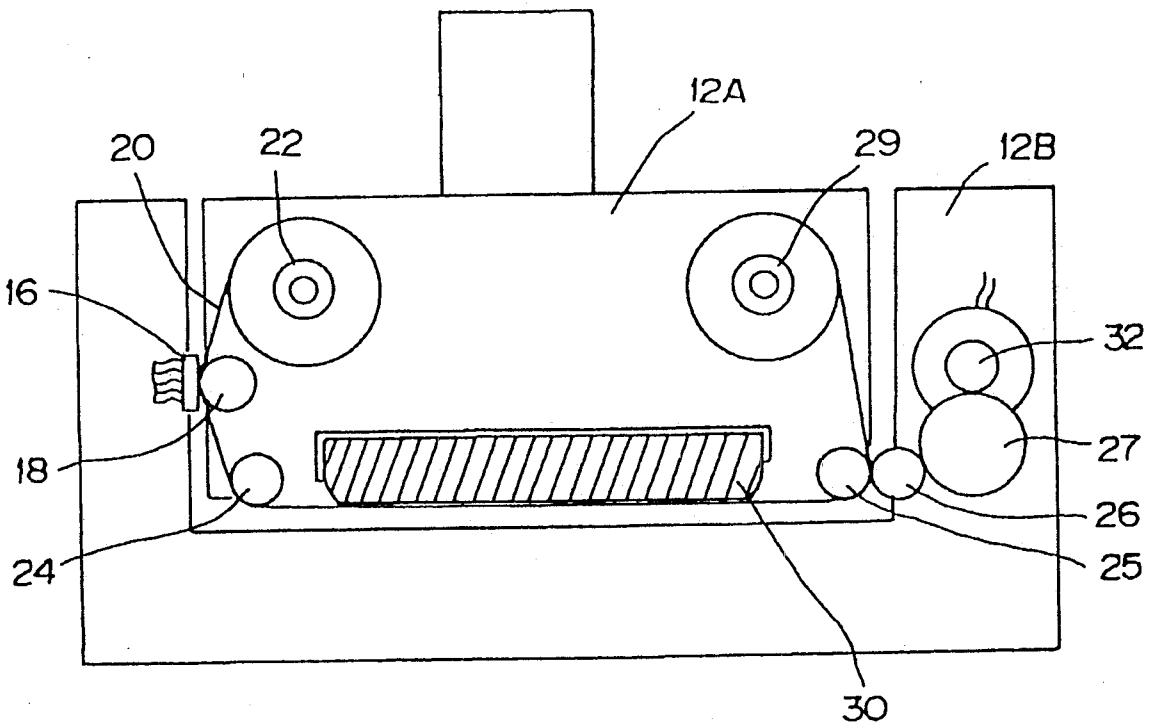
FIG. 2 is a sectional view taken on line 2—2 in FIG. 1.

Referring to FIG. 2, the stencil producing unit 12B is provided internally with a thermal head 16 which is capable of being pressed against a platen roller 18 provided internal to the stamping unit 12A of the stamping stencil producing device. Inside of the stamping unit 12A, thermal stencil paper (hereinafter referred to simply as "stencil paper") 20 unwinds from a feed spool 22 and is extended, via the platen roller 18, a guide roller 24, the lower surface of an ink pad 30, and a guide roller 25, to be taken up on a winding spool 29. Therefore, the stencil paper 20 passes between the thermal head 16 and the platen roller 18. The ink pad 30 functions as an ink supply means, the winding spool 29 functions as a second winding means and the feed spool 22 functions as a first winding means.

A feed roller 26 is disposed opposite to the guide roller 25 to advance the stencil paper 20, in cooperation with the guide roller 25, toward the winding spool 29. The feed roller 26 is driven for rotation by a drive gear 27 which is driven by a stencil paper feed motor 32.

The stencil paper 20 has a laminate structure formed by bonding a thermoplastic film and a porous carrier to each other using an adhesive layer. In the preferred embodiment of the stencil paper 20, the thermoplastic film is formed from a polyethylene terephthalate film having a thickness of 2 microns. The porous carrier is formed of a porous thin sheet of paper made primarily of a natural fiber such as vanilla hemp, kozo or mitzumata, a synthetic fiber such as PET, polyvinyl alcohol or polyacrylonitrile, or a synthetic fiber such as rayon. The thickness of the porous carrier is about 40 microns and is preferably in the range of 20–100 microns. The stencil paper 20 is wound on feed spool 22 and fed so that the thermoplastic film is in contact with the thermal head 16. The stencil paper 20, as described, is disclosed in U.S. patent application Ser. No. 07/812,107, concurrently filed Dec. 23, 1991 to TERUO IMAMAKI, TAKASHI MIKI AND TETSUJI FUWA and entitled "STAMP DEVICE EMPLOYING AN ELONGATED HEAT SENSITIVE STENCIL PAPER" the disclosure of which is incorporated herein by reference.

Figure 5:
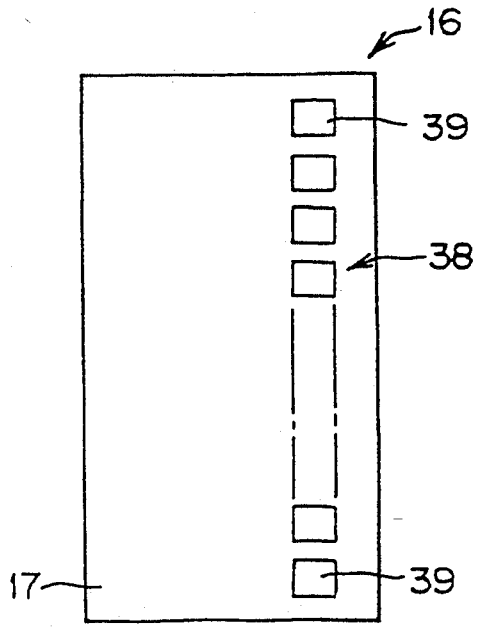
FIG. 5 is a front view of a thermal head.

Referring to FIG. 5, the thermal head 16 has a plurality of heating elements 39 which are arranged in a row 38 along the direction perpendicular to a stencil paper feed direction. The number of the heating elements is 448 with, in this embodiment, eight thermal elements per millimeter. The heating elements 39 are driven selectively in synchronism with the feed of the stencil paper 20 to form pores in the stencil paper 20 by thermal punching according to input data input by the keyboard 10.

Figure 6:
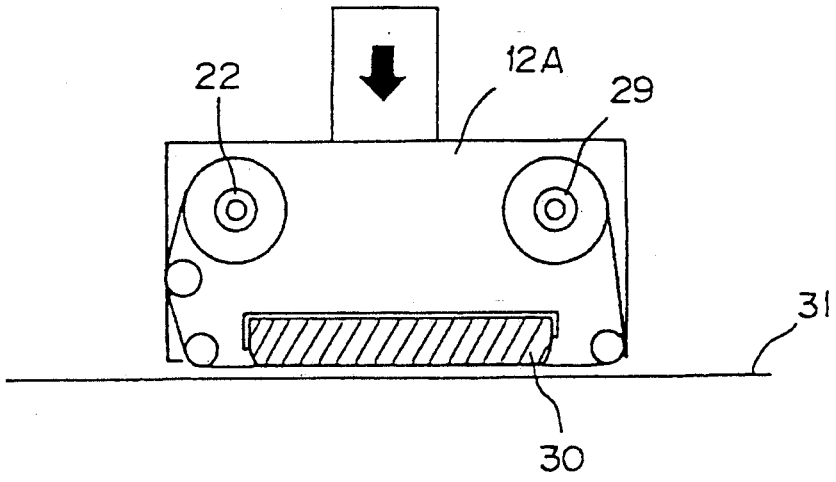
FIG. 6 is a sectional view of assistance in explaining the stamping operation of the device shown in FIG. 2.

The stencil paper 20 is advanced by a predetermined distance so that a section thereof provided with the pattern of pores formed by thermal punching is located directly under the ink pad 30. Then, the stamping unit 12A is separated from the stencil producing unit 12B and the stamping unit 12A is pressed against a recording sheet 31, as shown in FIG. 6, to supply the ink from the ink pad 30 to the stencil paper 20 and to transfer the ink through the pores to the recording sheet 31 to stamp characters and the like on the recording sheet 31.

As shown in FIG. 1, a keyboard 10 has a plurality of character keys 42 for inputting kana characters which are Japanese, alphabetic characters, symbols or numbers and the like, and function keys including a kana-kanji conversion key 47 for converting Japanese into Chinese, if appropriate, and a stamping stencil key 46 for starting the operation of creating a stamping stencil.

Figure 7:
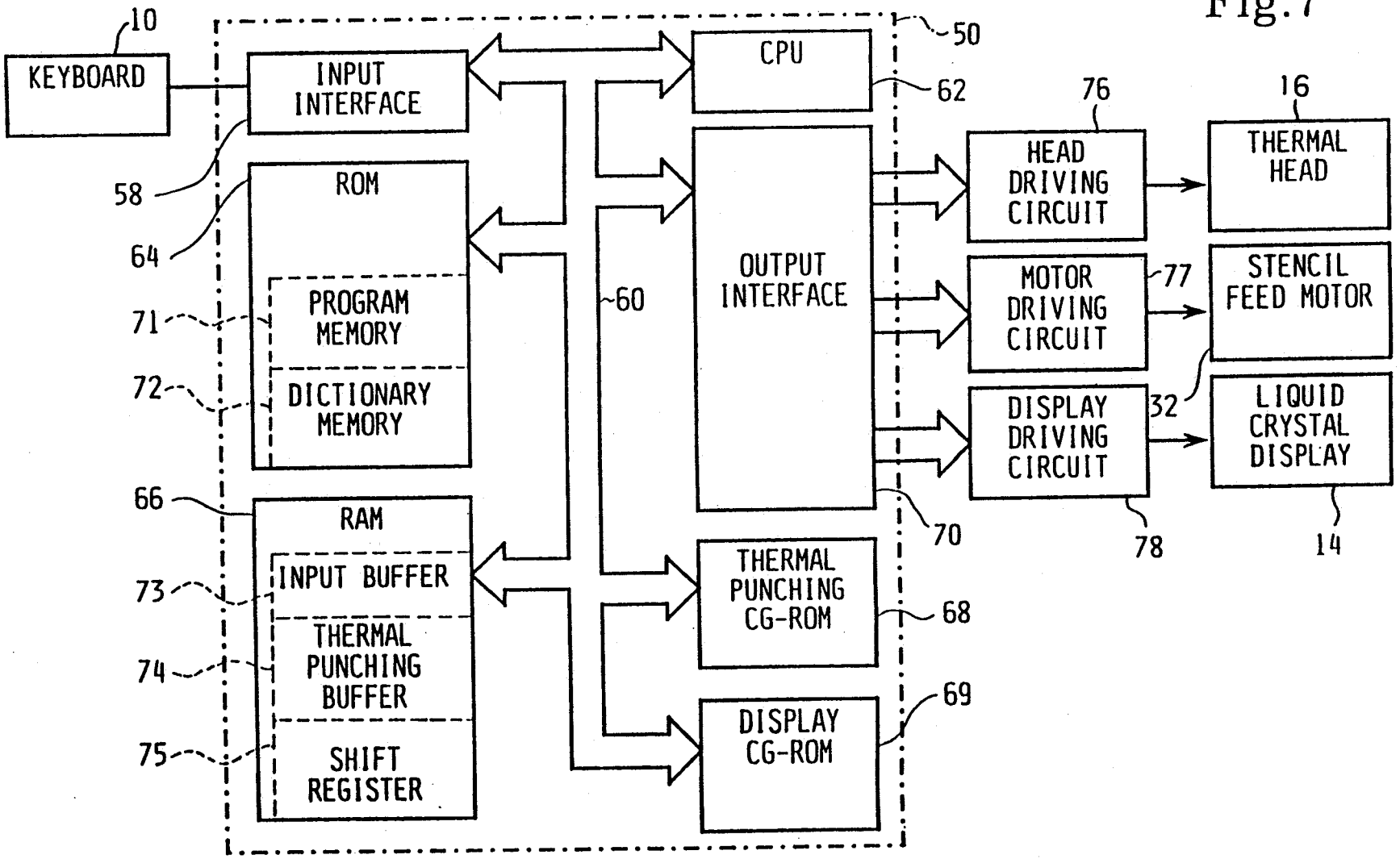
FIG. 7 is a block diagram of a control system incorporated into the stamping device.
Figure 10:
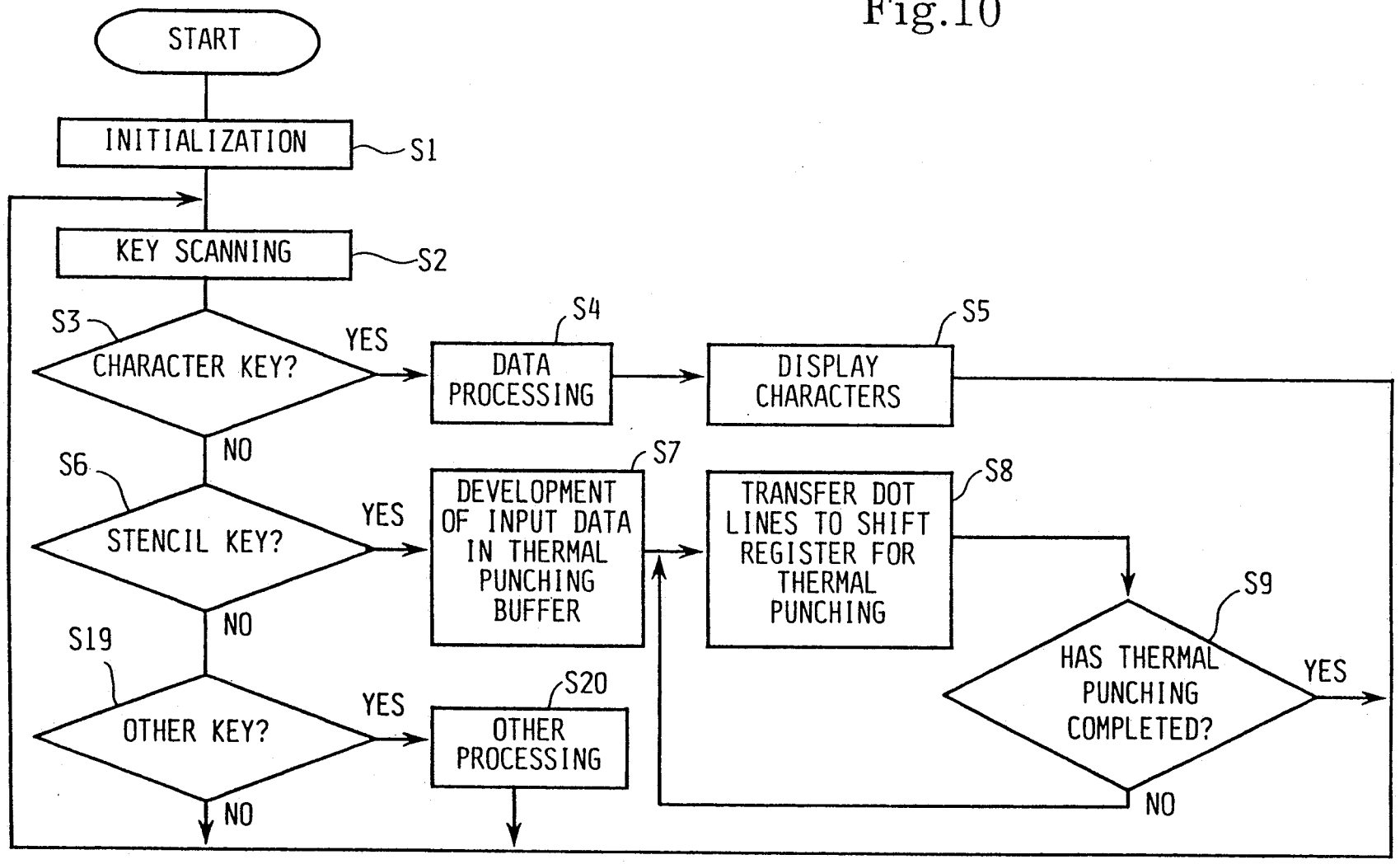
FIG. 10 is a flow chart showing essential steps of a stamping stencil producing program stored in a program memory shown in FIG. 7.

The electrical structure of the control system in the stamping device will be described with reference to FIG. 7. The keyboard 10 is connected to an input interface 58 of a microcomputer 50, the latter functioning as a control means. The input interface 58 is connected by a bus 60 to a CPU 62 for controlling the stamp device, a ROM 64 for storing a control program, as shown in FIG. 10, a RAM 66 that functions as storage means, a thermal punching character generator 68 (hereinafter referred to as "thermal punching CG-ROM") for generating characters for thermal punching by the thermal head 16, a display character generator 69 (hereinafter referred to as "display CG-ROM") for generating characters for the display 14, and an output interface 70.

The ROM 64 has a program memory 71 for storing programs to control the operation of the stamping device, and a dictionary memory 72 for kana-kanji or other appropriate conversions. The RAM 66 has counters (not shown) in addition to an input buffer 73, a thermal punching buffer 74 and a shift register 75.

The thermal punching CG-ROM 68 generates a dot pattern for thermal printing on the basis of input character code data. The display CG-ROM 69 generates a dot pattern to be displayed on the display 14 on the basis of input character code data.

A thermal head driving circuit 76, a motor driving circuit 77 and a display driving circuit 78 are connected to the output interface 70. The thermal head 16, the stencil paper feed motor 32 and the display 14 are connected respectively to the thermal head driving circuit 76, the motor driving circuit 77 and the display driving circuit 78.

Figure 8:
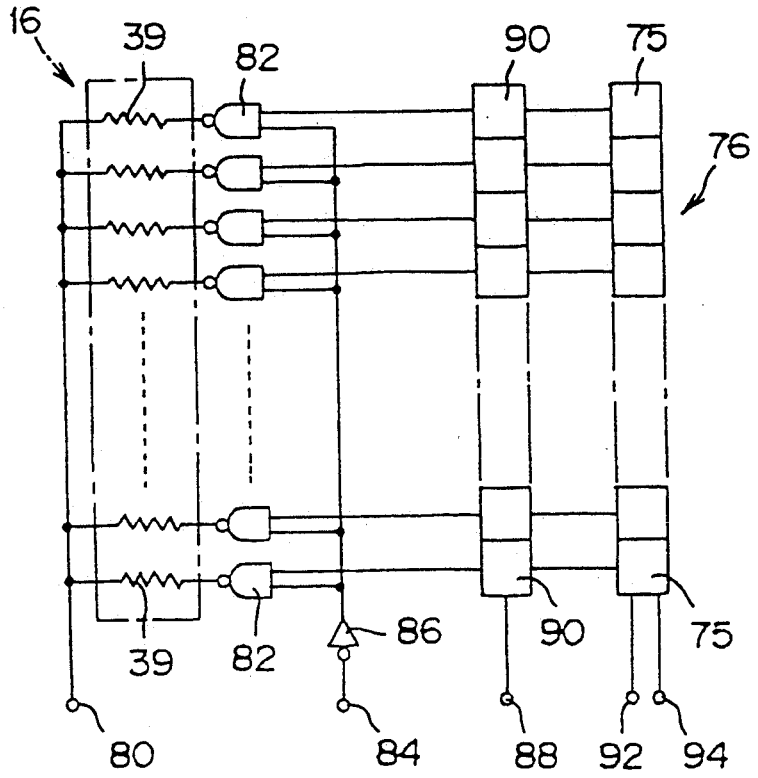
FIG. 8 is a circuit diagram of a thermal head driving circuit.

FIG. 8 shows the thermal head driving circuit 76. One of the electrodes of each of the heating elements 39 is connected to a power feed terminal 80 connected to the positive terminal of a 12 volt power supply. The other electrode of the power supply is connected to a ground of a driver 82. The output terminal of an inverter 86 has an input terminal connected to a thermal punching strobe input terminal 84 and the output terminal of a data latch circuit 90 has an input terminal which is connected to a latch signal input terminal 88. The other input terminal of the thermal punching drivers 82 is connected to an associated data latch circuit 90. The input terminal of each data latch circuit 90 is connected to the output terminal of a shift register 75 having input terminals connected respectively to a data input terminal 92 and a clock input terminal 94.

The control system orders that print data representing characters to be printed are stored in the shift registers 75 in synchronism with a clock signal. Upon the reception of a latch signal by the data latch circuits 90, the print data stored in the shift registers 75 are applied to and stored in the corresponding data latch circuits 90 and, at the same time, the same print data are applied to the thermal punching drivers 82. In this state, if a thermal punching pulse signal in the 0 state is applied to the input terminal through the thermal punching strobe input terminal 84, a signal in the 1 state is output at the output terminal of the inverter 86 connected to the input terminals of the thermal punching drivers 82. Accordingly, the output terminal of the thermal punching drivers 82 are in the 0 state when the data provided by the data latch circuits 90 are in the 1 state and, consequently, a driving current is supplied through the power feed terminal 80 to the corresponding heating element 39. The pulse width of the thermal punching pulse signal applied to the thermal punching strobe input terminal 84 is determined so that the heating elements 39 are heated to a surface temperature suitable for thermal punching, for example, a temperature greater than 200° C.

Figure 9A:
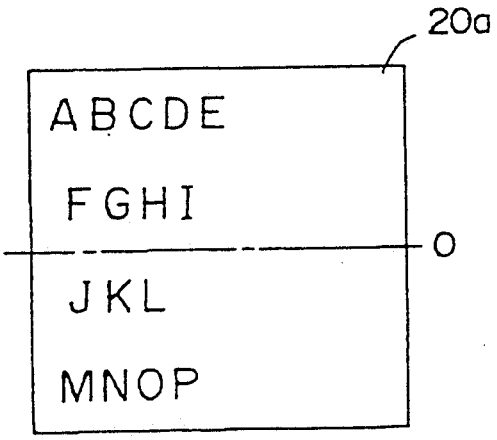
FIGS. 9(A) and 9(B) are a plan view of assistance in explaining the size of a thermal stencil paper to be subjected to thermal punching.
Figure 9B:
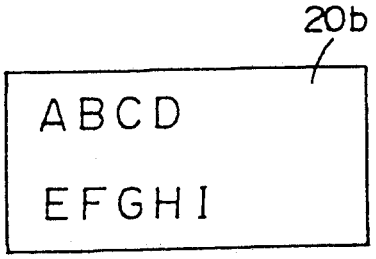

The stamping device in this embodiment is capable of producing a normal stamping stencil (hereinafter referred to as a "first stamping stencil") and a stamping stencil of a width different from that of the first stamping stencil (hereafter referred to as a "second stamping stencil"). As shown in FIG. 9(A), the input character strings are formed in either a first stamping stencil 20*a* using both of the two sections of the stencil paper demarcated by a center line 0 with respect to the width of the stencil paper, or as shown in FIG. 9(B), a second stamping stencil 20*b* is made using either the upper section or the lower section of the stencil paper. The thermal head 16 of the stamping device has a dot matrix consisting of 448 dots. Therefore, the 224 dots in the upper or lower half of the dot matrix are employed in forming the character strings for the second stamping stencil.

A stamping stencil producing program to be executed by the control system of the stamping device will be described with reference to FIG. 10.

Upon connection of the stamping device to a power supply, the buffers and the register of the RAM 66 are initialized in step S1. Thermal punching data entered by operating the character keys 42 is stored in the input buffer 73 in steps S2, S3 and S4, and then characters corresponding to the thermal punching data are read from the display CG-ROM 69 and are displayed on the display 14 in step S5. When the stamping stencil key 46 is pressed, step S7 is executed after steps S2 and S6 to develop a dot pattern, generated by the thermal punching CG-ROM 68, in the thermal punching buffer 74. Subsequently, dot lines of the dot pattern are transferred one dot line at a time to the shift register 75 and pores corresponding to the dot lines are formed in the stencil paper in step S8. A query is made in step S9 to see if all the pores corresponding to the thermal punching data have been formed. If the response in step S9 is negative, steps S8 and S9 are repeated. Thus, the dot pattern is formed in the stencil paper by the row 38 of the 448 heating elements 39.

The stamping device executes the stamping stencil producing program to form the desired character string on the stencil paper 20. After the section of the stencil paper 20 carrying the pores forming the character strings, is moved beneath the ink pad 30 in the stamping unit 12A, the stamping unit 12A is separated from the stencil producing unit 12B, and then the stamping unit 12A is pressed against a recording sheet as shown in FIG. 6 to stamp the desired character string on the recording sheet. The stamping device is able to form pores by thermal punching in a predetermined section on the stencil paper without modifying the stencil producing unit 12B and a stencil paper of a desired size can be produced. Accordingly, a stamping unit that can produce differently sized characters to be stamped is provided. When all stencil paper 20 has been used and has been taken up on winding spool 29, the stamping unit 12A is discarded and a new stamping unit 12A used. Thus, the stamping device is flexible and provides great economies.

Although the stamping device in this embodiment employs a thermal head having 448 heating elements arranged in the row 38, the number of the heating elements may be varied. The width of the thermal stencil paper forming the second stamping stencil need not necessarily be half the width of the thermal stencil paper forming the first stamping stencil, and a thermal stencil paper having an optional width may be used for forming the second stamping stencil.

A second embodiment will now be described in reference with FIGS. 11–16.

Figure 11:
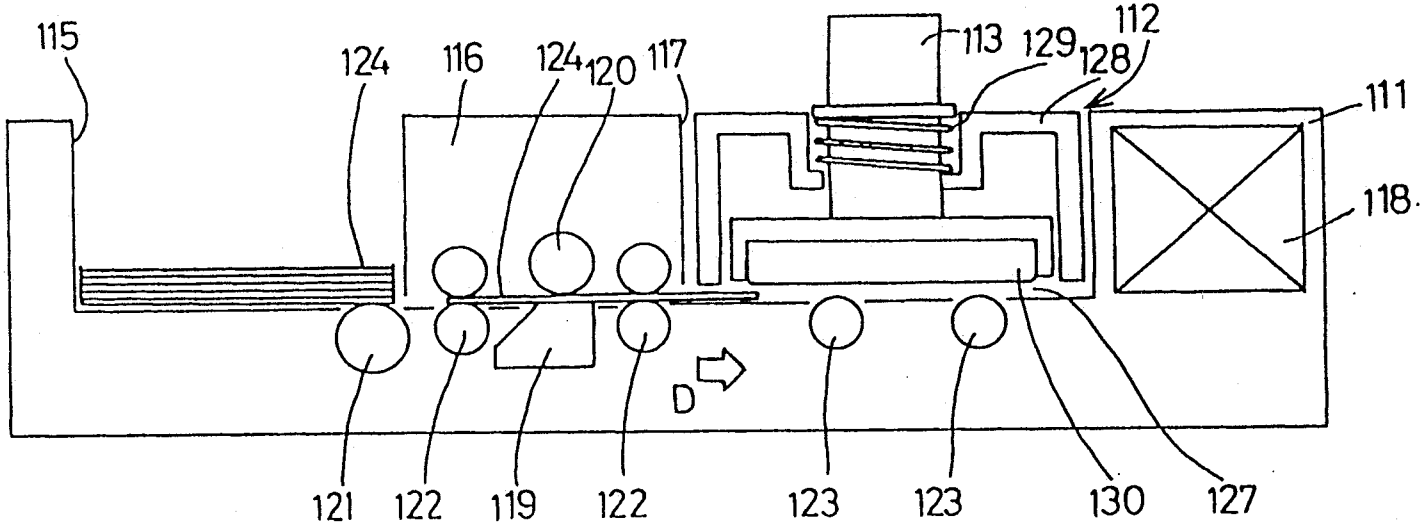
FIG. 11 is a sectional view of an electronic stamping device in the second embodiment, taken on line 11—11 in FIG. 12.
Figure 12:
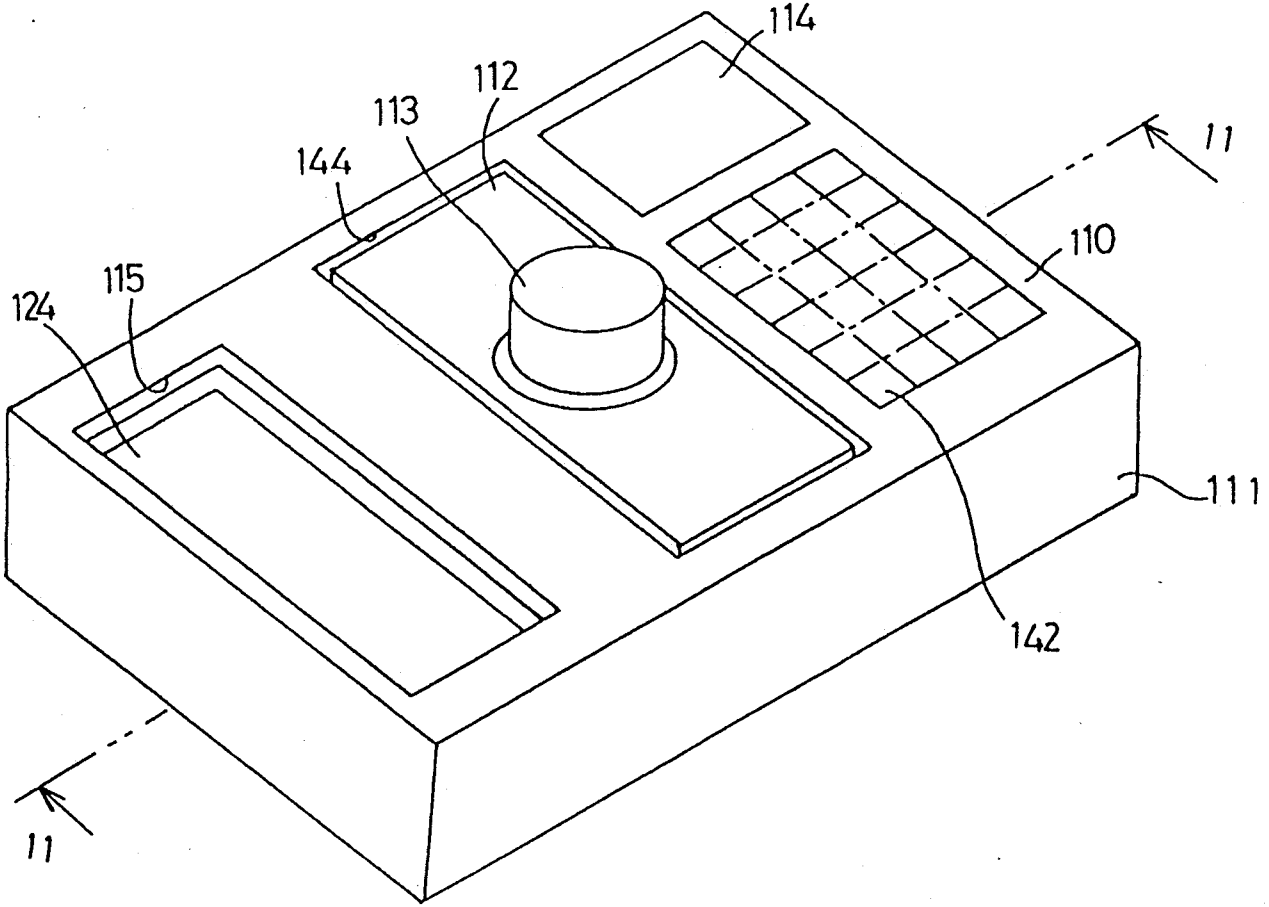
FIG. 12 is a perspective view of the electronic stamping device.

As shown in FIG. 12, the electronic stamping device has a keyboard 110, a main unit 111, a stamping unit 112, and a liquid crystal display 114 (hereinafter referred to simply as "display") having a predetermined number of display modules. The keyboard 110 is provided with character keys 142 for entering Japanese kana characters, alphabetic characters for other languages, figures and/or symbols, and function keys including a stamping stencil key. As shown in FIG. 11, the main unit 111 contains a stencil paper accommodating unit 115 for accommodating unused cut sheets of stencil paper 124, a stamping stencil producing unit 116, a stamp holder 117 and a control unit 118. The stamping unit 112 comprises a handle 113, a stamp body 128, a spring 129 and an ink pad 130.

In the main unit 111, the key board 110 is adjacent to the display 114. The stamp unit 112 is disposed in the middle of the main unit 111 and is adjacent to the key board 110 and the display 114 and the stencil paper accommodating unit 115 is adjacent to the stamp unit 112 on a side opposite that of the keyboard 110 and the display 114.

Referring to FIG. 11, the stamping stencil producing unit 116 is provided with a thermal head 119. The thermal head 119 can be pressed against a platen roller 120. A feed roller 121 pulls a thermal stencil paper 124 from the stencil paper accommodating unit 115 and feed rollers 122 introduce the thermal stencil paper 124 into the stamping stencil producing unit 116 between the thermal head 119 and the platen roller 120. After the pores have been formed by the thermal head 119 by thermal punching, the thermal stencil paper 124 is transported by delivery rollers 122 and 123 to a position under the stamping unit 112.

The ink pad 130 and the delivery rollers 123 are supported, with a space 127 therebetween, in the stamp body 128 of the stamping unit 112. When the handle 113 of the stamping unit 112 is depressed against the resilience of the spring 129 toward the thermal stencil paper 124, after the thermal stencil paper 124 has been placed under the stamping unit 112, the ink pad 130 is brought into contact with the thermal stencil paper 124 and, consequently, the thermal stencil paper 124 is caused to stick to the ink pad 130 by the viscosity of the ink of the ink pad 130.

Figure 13:
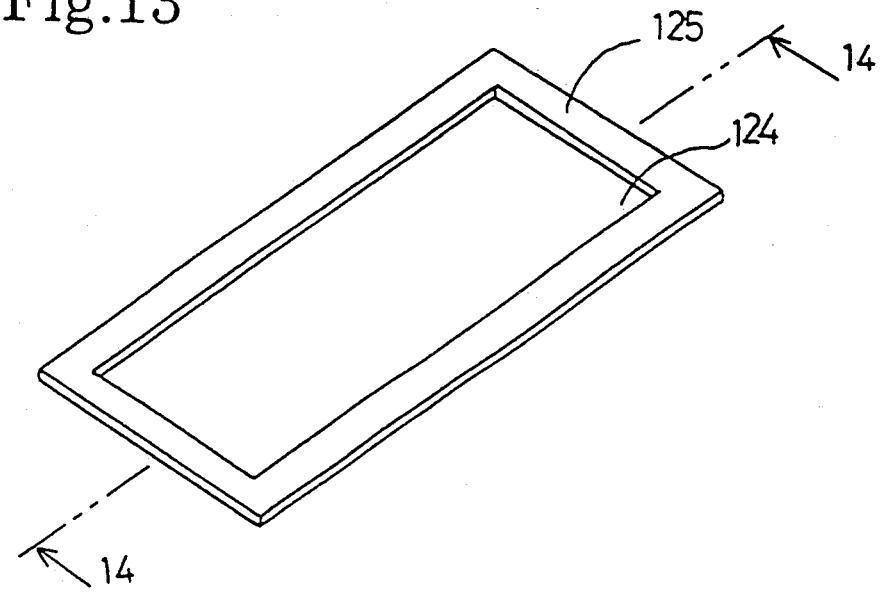
FIG. 13 is a perspective view of a thermal stencil paper to be used by the electronic stamping device.
Figure 14:
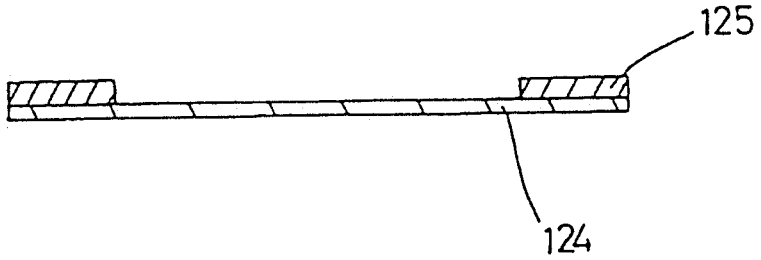
FIG. 14 is a sectional view taken on line 14—14 in FIG. 13.
Figure 15:
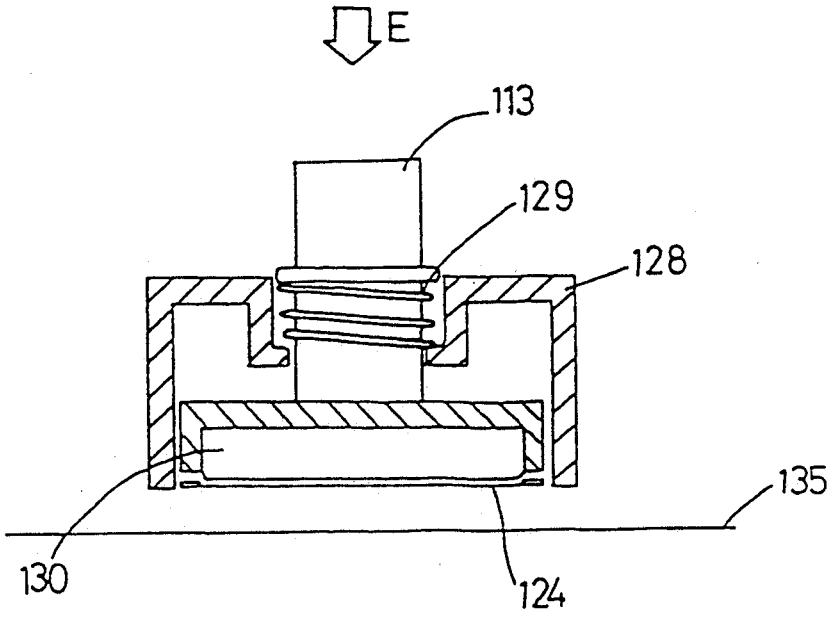
FIG. 15 is a sectional view of assistance in explaining the stamping operation of the electronic stamping device.

The thermal stencil paper 124 is formed by adhesively putting a thermoplastic film on a porous foundation. The thermal stencil paper 124 is fed over the thermal head 119 so that the thermoplastic film faces the thermal head 119. As shown in FIG. 13, the thermal stencil paper 124 is attached adhesively to a frame 125.

The thermal head 119 has a head body provided with a plurality of heating elements, in this embodiment there are 448 heating elements, arranged in a row extending in a direction perpendicular to the direction of feed of the thermal stencil paper 124. The heating elements are driven in synchronism with the movement of the thermal stencil paper 124 to form pores in the thermal stencil paper 124 by thermal punching according to the data entered by operating the keyboard 110. The thermal stencil paper 124, having the pores formed by thermal punching, is advanced by the delivery rollers 122 and 123 by a predetermined distance so that the thermal stencil paper 124 is placed under the ink pad 130.

The control system of the electronic stamping device in the second embodiment has the same structure as the control system of the electronic stamping device in the first embodiment. Therefore, common elements are designated with the same reference members and a detailed explanation of the control system of the electronic stamping device is omitted.

The stamping stencil producing operation of the electronic stamping device will be explained.

The keyboard 110 is operated to enter characters. The characters entered by operating the keyboard 110 are displayed on the display 114. Thermal punching data are entered by operating the character keys 142 and the thermal punching data are stored in the input buffer 73, the display CG-ROM 69 generates characters corresponding to the thermal punching data and the characters are displayed on the display 114. When the stamping stencil key is pressed, a dot pattern generated by the thermal punching CG-ROM 68 on the basis of the input code data in the thermal punching buffer 74, is developed.

Subsequently, dot lines of the dot pattern are transferred one dot line at a time to the shift register 175 and pores corresponding to the dot lines are formed in the thermal stencil paper. A query is made to see if all the pores corresponding to the thermal punching data have been formed. If all the pores corresponding to the thermal punching data have not been formed, dot lines of the dot pattern are transferred one dot line at a time to the shift register 75 and pores corresponding to the dot lines are formed in the thermal stencil paper. Thus, the dot pattern is formed in the stencil paper by the 448 heating elements. As shown in FIG. 11, the thermal stencil paper 124 is advanced in the direction of the arrow D by the delivery rollers 122 and 123.

Figure 16:
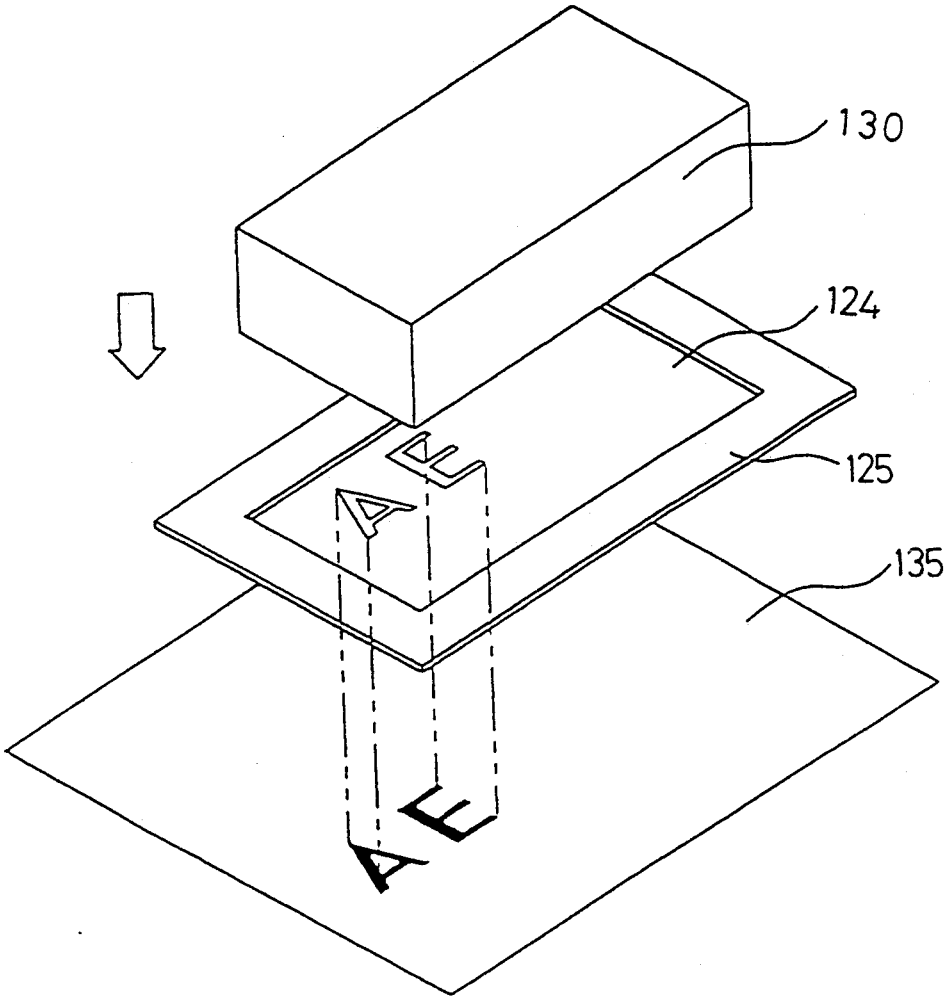
FIG. 16 is a pictorial view of assistance in explaining the stamping operation of the electronic stamping device.

After the thermal punching operation has been completed, the handle 113 of the stamping unit 112 is pressed against the resilience of the spring 129, toward the thermal stencil paper 124, to bring the ink pad 130 into contact with the thermal stencil paper 124 and the thermal stencil paper 124 is adhered to the ink pad 130 by the viscosity of the ink found in the ink pad 130. Then, the stamping unit 112 is extracted from the stamp holder 117 of the main unit 111 of the electronic stamping device. The stamping unit 112 is pressed against a recording sheet 135 as indicated by the arrow E in FIG. 15 to stamp the characters on the recording sheet 135 by transferring the ink through the pores of the thermal stencil paper 124 to the recording sheet 135 as shown in FIG. 16.

Although the electronic stamping device in this embodiment employs a thermal head having 448 heating elements, the number of the heating elements may be varied.

If it is desired to stamp other characters, the thermal stencil paper 124 adhered to the ink pad 130 of the stamping unit 112 is removed, the stamping unit is set in the stamp holder 117 of the main unit 111 of the electronic stamping device, and then the foregoing stamping stencil producing procedure is carried out to produce another stamping stencil. The thermal stencil papers 124 are stored for the future use. Therefore, the same thermal stencil papers 124 need not be produced again, which is economically advantageous.

As is apparent from the foregoing description, according to the second embodiment, stamping stencils can readily be produced by anybody, and the ink need not be applied by hand to the stamping stencil. Thus, the electronic stamping device is accessible and economically advantageous.

Figure 17:
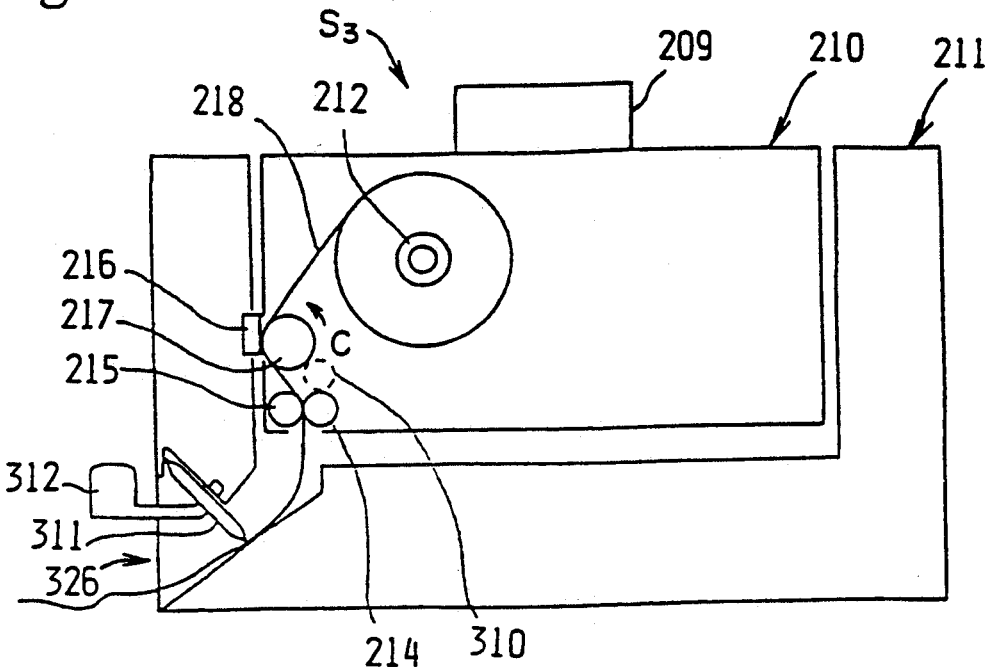
FIG. 17 is a sectional side view showing a stamping device in a third embodiment.
Figure 18:
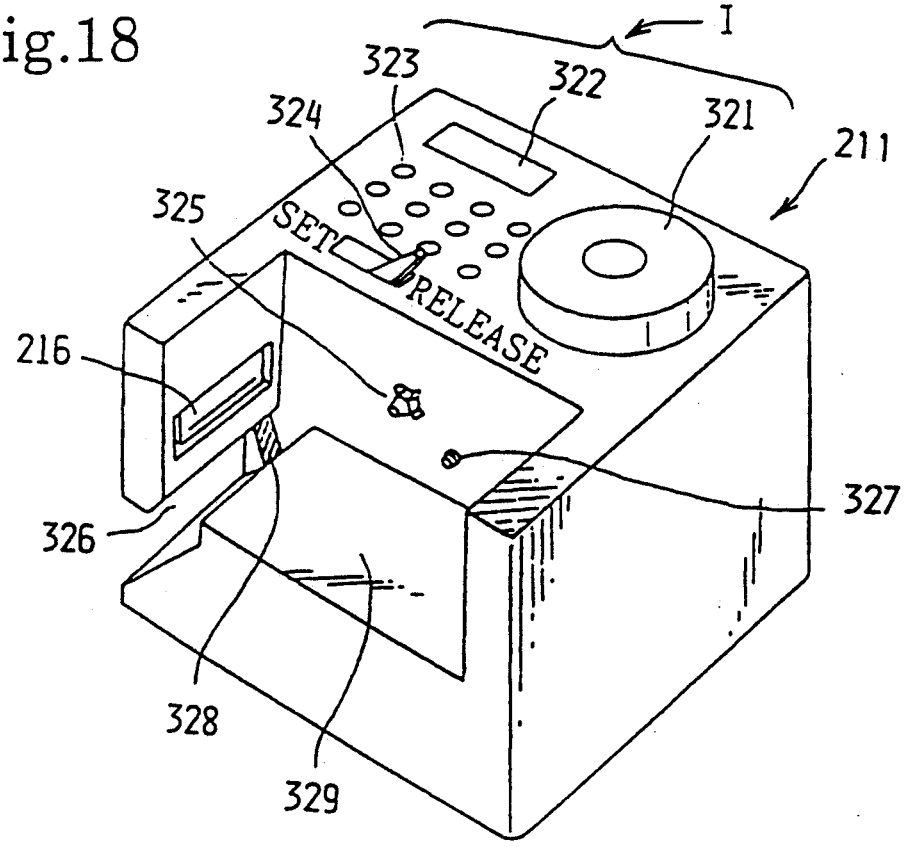
FIG. 18 is a perspective view showing a stamping stencil producing unit of device in the third embodiment.

A stamping device of a third embodiment will be described with reference to FIGS. 17-20. FIG. 17 is a side view of a stamping device $S_3$ and FIG. 18 is a perspective view of the stamping device $S_3$.

First, a stamping cartridge 210 will be described. Referring to FIG. 17, the stamping device $S_3$ employs a thermal stencil web 218 formed by adhesively joining a film of a thermoplastic resin and a porous foundation as employed in the first embodiment. This stamping device $S_3$ uses a thermal stencil stamping cartridge 210 comprising a stencil feed shaft 212 on which the thermal stencil web 218, wound in a roll, is supported. An end of the thermal stencil web 218 is fed to a platen 217. The thermal stencil web 218 is extended from the roll of the thermal stencil web 218, supported on the stencil feed shaft 212, via a platen 217 to a path between the feed roller 214 and a pressure roller 215.

The thermal stencil stamping cartridge 210 is mounted on a stamping stencil producing unit 211. A thermal head 216 provided in the stamping stencil producing unit 211 is pressed against the platen 217 with the thermal stencil web 218 therebetween. The thermal head 216 is provided with a plurality of heating elements, which are driven for heating according to image data provided by a controller (not shown), while the platen 217 is rotated in the direction of the arrow C, to form pores in a pattern, to make a stamping stencil, corresponding to the image data in the thermal stencil web 218. The stamping cartridge 210 comprises a platen roller 217, a feed roller 214, a pressure roller 25, and an intermediate gear 310 for transmitting the rotation of the platen 217 to the feed roller 214.

The stamping stencil producing unit 211 comprises a thermal head 216, and a cutting blade 311 for cutting a section forming a stamping stencil of the thermal stencil web 218, and a cutter operating lever 312 for operating the cutting blade 311.

The operation of the components shown in FIG. 17 will be described hereinafter. The control system of the electronic stamping device in the third embodiment has the same structure as the control system of the electronic stamping device in the first embodiment.

The stamping stencil producing unit 211 controls the pattern forming operation of the thermal head 216 to form pores in a desired pattern in the thermal stencil web 218, and controls the operation of a motor (not shown) for driving the platen 217 for rotation. Desired patterns of pores are entered beforehand by means of a character input unit I (FIG. 18) and stored in a memory 66.

The platen roller 217 rotates in the direction of the arrow C pressing the thermal stencil web 218 against the thermal head 216 to feed the thermal stencil web 218 by a predetermined distance at a time. The heating elements of the thermal head 216 are energized selectively according to the desired pattern in synchronism with the feed of the thermal stencil web 218. Thus, pores are formed in the desired patterns, such as characters and symbols, in the thermal stencil web 218. The feed roller 214 is driven for rotation through the intermediate gear 310 by the platen roller 217 to advance the thermal stencil web 218 frictionally in cooperation with the pressure roller 215. After a stamping stencil has thus been made, the thermal stencil web 218 is advanced by a distance corresponding to a margin necessary for mounting the stamping stencil on a simple stamping unit, which will be described later.

The construction of the stamping stencil producing unit 211 will be described hereinafter with reference to FIG. 18.

The character input unit I comprises a character selecting dial 321, a display 322 and function keys 323. Characters and symbols are marked on the upper surface of the character selecting dial 321 in a circumferential arrangement. For example, a mark indicating a desired character is set at a predetermined position by turning the character selecting dial 321, and a predetermined one of the function keys 323, is depressed. Then, a character code representing the desired character is entered into an internal input control unit (not shown), the character code is stored and edited, and the desired character is displayed on a display 322 comprising LCDs or the like. The input key is operated repeatedly to enter desired characters and, then, function keys 323, including an insertion key, a delete key, a conversion key, and a scroll key, are operated sequentially and repeatedly to determine the details of a pattern of pores to be formed in the thermal stencil web 218 by exerting edit functions.

After the edit operation has been completed, a thermal head operating lever 324 is put at a release position, the thermal stencil stamping cartridge 210 is placed on a cartridge bed 329 and the thermal head operating lever 324 is put at a set position to press the thermal stencil web 218 between the thermal head 216 and the platen roller 217. Then, the platen roller 217 is rotated in the direction of the arrow C (FIG. 17) through a platen driving gear 325 by a motor (not shown) installed in the stamping stencil producing unit 211. A cartridge identifying bar 327 identifies the cartridge placed on the cartridge bed 329 since this stamping stencil producing unit 211 can use the thermal stencil stamping cartridge 210, shown in FIG. 17, and the stamping unit 12A, shown in FIG. 2, selectively. If the stamping unit 12A, shown in FIG. 2, provided with the ink pad 30 (FIG. 18) is placed on the cartridge bed 329, the thermal stencil web 218 is advanced so that the stamping stencil section provided with the pattern of pores is located opposite to the ink pad 30. If the thermal stencil stamping cartridge 210 is placed on the cartridge bed 27, the thermal stencil web 218 is advanced by a distance corresponding to a margin necessary for mounting the stamping stencil section provided with the pattern of pores on a simple stamping unit 340 (FIGS. 19 and 20), which will be described hereunder.

The cutting blade 311, provided with the cutter operating lever 312 is supported for manual operation in a cutting section 328 in the stamping stencil producing unit 211. A stamping stencil produced by processing the thermal stencil web 218 of the thermal stencil stamping cartridge 210 is ejected through an outlet 326.

As mentioned above, the stamping stencil producing unit 211 is capable of operating in combination with the prior art stamping cartridge 210 without requiring any modification. When the stamping unit 12A, shown in FIG. 2 is used in combination with the stamping stencil producing unit 211, the cutting blade 311 and the outlet 326 are not used while the character input unit I, the thermal head operating lever 24 and the thermal head 216 operate normally.

The simple stamping unit 340 will be described hereinafter with reference to FIGS. 19 and 20. The stamping unit 340 uses a stamping stencil, produced by the using the thermal stencil stamping cartridge 210, for stamping.

Figure 19:
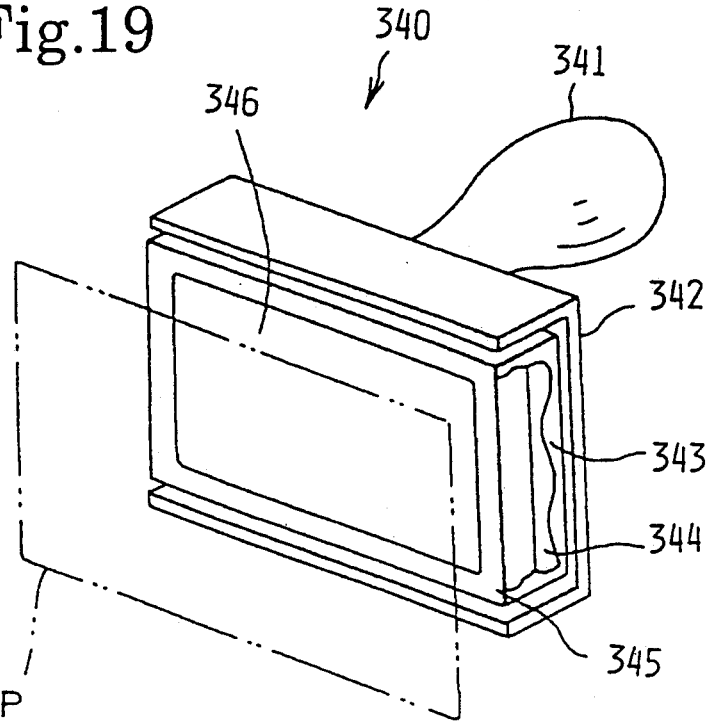
FIG. 19 is a perspective view showing simple stamping unit of a stamping device in the third embodiment.
Figure 20:
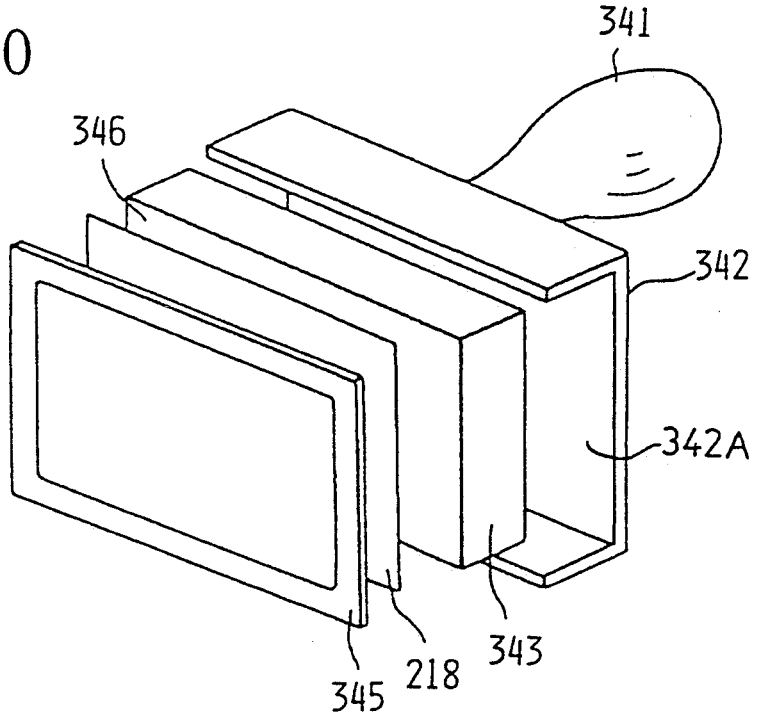
FIG. 20 is a exploded perspective view showing a simple stamping unit of a stamping device in the third embodiment.
Figure 21:
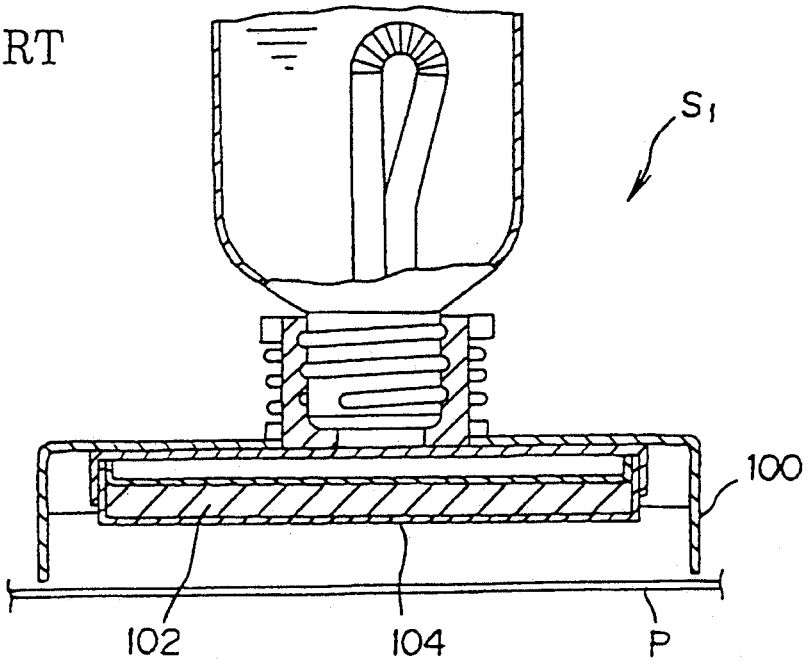
Fig.21 PRIOR ART
FIG. 21 is a sectional view showing a conventional stamping device.

As shown in FIGS. 19 and 20, an inner frame 343 holding an ink pad is inserted in an outer frame 342 having a U-shaped cross section. The inner frame 343 is held in a retracted position, that is within the confines of outer frame 342, by a spring (not shown) that couples the backside of inner frame 343 and the inner main surface 342A of outer frame 342. A grip 341 passes through the outer frame 342 and is removably fixed to the center of the backside of the inner frame 343. A stamping stencil formed by processing the thermal stencil web 218 is positioned next to the stamping surface 346 of the ink pad with end portions 344 (one end shown) fastened to the inner frame 343 with a fixing frame 345. After the stamping stencil has been fastened to the inner frame 343, the stamping unit 340 is put on a recording sheet P with the stamping surface 346 of the ink pad facing but separated from the recording sheet P, and then the grip 341 is depressed to compress the ink pad impregnated with the ink. Consequently, the ink is transferred from the ink pad through the pores, formed in the stamping stencil by processing the thermal stencil web 218, to the recording sheet P. The length of the stamping stencil is dependent on the lateral length of the stamping surface of the ink pad of the simple stamping unit 340.

As is apparent from the foregoing description, according to the third embodiment, a stamping stencil having an optional length can be produced by processing a thermal stencil web stored in a roll and hence clear characters can readily be stamped on a large recording sheet.

It is to be understood that the invention is not limited to the above described embodiments, and various modifications and alterations can be made thereto without departing from the scope of the invention as encompassed by the appended claims.

What is claimed is:

1. A portable stamping device, comprising:

a stencil producing unit further comprising:

data input means providing a plurality of characters for enabling an operator to selectively input desired ones of the plurality of characters to make up image data to be used to produce a stamping stencil;

thermal head means for forming pores by heat in a thermal stencil paper at a printing position on the basis of the data input by said data input means; and stenciling sheet supplying means for supplying the thermal stencil paper from a supply position to the printing position;

the portable stamping device also comprising means for use of the thermal stencil paper, having pores therein, that is separate from the stencil producing unit, said means for use having an ink supply means for supplying the pores formed in the thermal stencil paper with ink at an ink supplying position and used for printing when separated from said stencil producing unit.

2. The portable stamping device according to claim 1, wherein said stenciling sheet supplying means comprises first winding means mounted in said stamping unit for feeding thermal stencil paper.

3. The portable stamping device according to claim 1, wherein said stenciling sheet supplying means comprises second winding means mounted in said stamping unit for winding used thermal stencil paper.

4. The portable stamping device according to claim 1, wherein said stenciling sheet supplying means comprises first winding means for feeding thermal stencil paper and second winding means for winding used thermal stencil paper, said first and second winding means mounted in said stamping unit with said ink supplying position disposed between said first winding means and second winding means.

5. The portable stamping device according to claim 1, further comprising first winding means for feeding thermal stencil paper and second winding means for winding used thermal stencil paper, wherein said first and second winding means are both mounted in said separate stamping unit capable of being separated from said stencil producing unit of the portable stamping device.

6. The portable stamping device according to claim 1, further comprising storage means for storing the data input by the input means.

7. The portable stamping device according to claim 1, further comprising an image display for displaying the data concerning an image input by said input means prior to production of the stencil.

8. The portable stamping device according to claim 1, wherein said data input means has a stamping stencil key for starting an operation of producing a stamping stencil.

9. The portable stamping device according to claim 1, wherein said stencil producing unit further comprises:

display means for displaying the data input by said data input means and a stencil sheet accommodating portion for holding a plurality of stencil sheets, wherein said display means and said data input means are adjacent each other and said thermal head means is disposed between said stencil sheet accommodating portion and said display means and data input means.

10. The portable stamping device according to claim 1, further comprising control means which is capable of dividing the thermal stencil paper into two sections in a predetermined ratio of size with respect to the direction of the width of the thermal stencil paper on the basis of an input signal applied to said input means, and of forming character strings of a desired width only in one of the two sections.

11. The portable stamping device according to claim 1, further comprising a replaceable cartridge containing a roll web of the thermal stencil paper for mounting in said stencil producing unit, and said stencil producing unit further comprises an eject portion for ejecting an end of the stencil paper wherein the stencil paper having pores in the web is sent out from the eject portion of the cartridge to eject sequentially from the stamping device.

12. A stamping device comprising:

a housing;

data input means on said housing providing a plurality of characters enabling an operator to selectively input desired ones of the plurality of characters to create image data;

stencil paper accommodating means provided on said housing for accommodating a plurality of stencil papers which are in a form of a cut sheet;

stamping stencil producing means provided at a first location of said housing, said stamping stencil producing means having a head means for forming pores in the stencil paper on the basis of the image data input by said data input means;

stamping means having an ink supply means for supplying ink to pores formed in the stencil paper, said stamping means being removable from the housing for stamping and replaceable in the housing;

stamp holding means, provided at a second location of said housing, for removably and replaceably holding said stamping means; and paper feeding means for sequentially feeding the stencil paper from said stencil paper accommodating means to said first location and then to said second location.

13. The stamping device according to claim 12, further comprising a display means for displaying the image data input by said data input means.

14. The stamping device according to claim 12, further comprising a storage means for storing the image data input by said data input means.

15. The stamping device according to claim 12, wherein said data input means has a stamping stencil key for starting an operation of forming pores in the stencil paper.

16. The stamping device according to claim 12, wherein said stencil paper is a thermal stencil paper and said head means is a thermal head.

17. The stamping device according to claim 12, wherein said stencil paper has two sections in a predetermined ratio of size with respect to the direction of the width of said stencil paper, and said head means forms character strings of a desired width only in one of the two sections according to the image data from said data input means.

18. The stamping device according to claim 12, wherein each thermal stencil paper accommodated in said stencil paper accommodating means is attached adhesively to a frame.

19. The stamping device according to claim 12, wherein said stamping stencil producing means is disposed between said stencil paper accommodating means and said stamp holding means.

20. The stamping device according to claim 12, wherein said paper feeding means has a substantially straight feed path extending between said stencil paper accommodating means and said stamp holding means.

21. A stamping device comprising:

a housing;

data input means on said housing providing a plurality of characters for enabling an operator to selectively input desired ones of the plurality of characters to create image data;

stamping stencil producing means provided in said housing and having a head means operative on the basis of the image data input by said data input means; and a stamping unit removable from for stamping and replaceable in said housing, said stamping unit having means for accommodating a roll of stencil paper and an ink supply means for supplying ink to pores formed in the stencil paper by operation of said head means.

22. The stamping device according to claim 21, further comprising a display means for displaying the image data input by said data input means.

23. The stamping device according to claim 21, further comprising a storage means for storing the image data input by said data input means.

24. The stamping device according to claim 21, wherein said data input means has a stamping stencil key for starting an operation of forming pores in the stencil paper.

25. The stamping device according to claim 21, wherein said stencil paper is a thermal stencil paper and said head means is a thermal head.

26. The stamping device according to claim 21, wherein said stamping unit includes a platen roller being confronted with said head means disposed in said stamping stencil producing means.

27. The stamping device according to claim 21, wherein said stamping unit includes a guide roller and said housing includes a feed roller, said guide roller and said feed roller cooperating to feed said stencil paper.

28. The stamping device according to claim 21, wherein said stencil paper has two sections in a predetermined ratio of size with respect to the direction of the width of said stencil paper, and said head means forms character strings of a desired width only in one of the two sections according to the image data from said data input means.

29. The stamping device according to claim 21, wherein said stamping unit comprises first winding means for feeding the stencil paper and second winding means for winding the used stencil paper.

30. A stamping device comprising:

a housing;

data input means on said housing providing a plurality of characters for enabling an operator to selectively input desired ones of the plurality of characters to create image data;

stamping stencil producing means provided in said housing and having a thermal head operative on the basis of the image data input by said data input means;

display means provided on said housing for displaying the input image data to an operator upon input; and a stamping cartridge removable from and replaceable in said housing and including a thermal stencil paper of web type, at least a pair of feed rollers, and an outlet for discharging the thermal stencil paper from said stamping cartridge, wherein said stamping cartridge further includes a platen roller that confronts said thermal head disposed in said stamping stencil producing means and said stamping cartridge can be mounted on said housing exchangeably with a stamping means that includes means for accommodating a roll of stencil paper and an ink supply means for supplying ink to pores formed in the stencil paper.

31. The stamping device according to claim 30, further comprising a cutting mechanism for cutting the stencil paper on which the pores are formed on the basis of the image data input by said data input means, wherein said housing includes an eject portion associated with said outlet for ejecting the cut stencil paper from said housing.

* * * * *